US009688360B2

(12) United States Patent
Hajeri

(10) Patent No.: US 9,688,360 B2
(45) Date of Patent: Jun. 27, 2017

(54) FLOATING SUPPORT ANCHORED ON A REEL COMPRISING A GUIDE AND DEFLECTION CONDUIT FOR FLEXIBLE PIPES WITHIN SAID REEL

(71) Applicant: SAIPEM S.A., Montigny le Bretonneux (FR)

(72) Inventor: Yann Hajeri, Lezignan la Cebe (FR)

(73) Assignee: Saipem S.A., Montigny le Bretonneux (FR)

( * ) Notice: Subject to any disclaimer, the term of this patent is extended or adjusted under 35 U.S.C. 154(b) by 0 days.

(21) Appl. No.: 14/785,546

(22) PCT Filed: Apr. 17, 2014

(86) PCT No.: PCT/FR2014/050941

§ 371 (c)(1),
(2) Date: Oct. 19, 2015

(87) PCT Pub. No.: WO2014/170615

PCT Pub. Date: Oct. 23, 2014

(65) Prior Publication Data

US 2016/0096593 A1 Apr. 7, 2016

(30) Foreign Application Priority Data

Apr. 19, 2013 (FR) ..... 13 53618

(51) Int. Cl.
*B63B 35/44* (2006.01)
*B63B 21/50* (2006.01)

(52) U.S. Cl.
CPC ..... *B63B 21/507* (2013.01); *B63B 35/44* (2013.01); *B63B 2035/448* (2013.01)

(58) Field of Classification Search
CPC ..... B63B 21/507
See application file for complete search history.

(56) References Cited

U.S. PATENT DOCUMENTS 4,305,341 A 12/1981 Stafford
5,517,937 A * 5/1996 Lunde ..... B63B 21/507 114/179
5,823,837 A 10/1998 Boatman
(Continued)

FOREIGN PATENT DOCUMENTS

FR 2 928 899 9/2009
FR 2 935 679 3/2010
(Continued)

*Primary Examiner* — Edwin Swinehart
(74) *Attorney, Agent, or Firm* — Cozen O'Connor

(57) ABSTRACT

A floating petroleum production support having a turret passing a plurality of flexible first pipes connected to a top platform. The turret includes at least one guide and offset pipe for containing and guiding a flexible first pipe and passing inside the cylindrical internal structure of the turret non-vertically between:

a) a bottom wall at a first location (C1) of the bottom wall where the guide pipe is fastened; and b) an internal platform above the bottom wall, the top end of the guide pipe being fastened to the internal platform at a second location (C2) where the top end of the flexible pipe contained in the guide pipe is fastened or is suitable for being fastened, the second location not being in vertical alignment with the first location.

13 Claims, 6 Drawing Sheets

(56) References Cited

U.S. PATENT DOCUMENTS

| | | | | |
|---|---|---|---|---|
| 6,014,939 | A | 1/2000 | Gusmeri et al. | |
| 2014/0069657 | A1* | 3/2014 | Povloski ..... | E21B 17/015<br>166/345 |

FOREIGN PATENT DOCUMENTS

| | | |
|---|---|---|
| GB | 2 122 139 | 1/1984 |
| WO | WO 93 24733 | 12/1993 |
| WO | WO 99/17983 | 4/1999 |
| WO | WO 01/51347 | 7/2001 |

* cited by examiner

FLOATING SUPPORT ANCHORED ON A REEL COMPRISING A GUIDE AND DEFLECTION CONDUIT FOR FLEXIBLE PIPES WITHIN SAID REEL

PRIORITY CLAIM

This is a U.S. National stage of application no. PCT/FR2014/050941, filed on Apr. 17, 2014. Priority is claimed on France, application no. FR 13536618 filed Apr. 19, 2013, the content of which is incorporated herein by reference.

The present invention relates to a bottom-to-surface connection installation between a plurality of undersea pipes resting on the sea bottom and a floating support on the surface, the installation comprising a plurality of flexible pipes, each having its top end secured to a turret that is substantially stationary relative to sea bottom, the floating support pivoting freely about said turret, the turret being situated at the front of the floating support or within said floating support, generally in the front third of said floating support.

The present invention also relates to a said floating support anchored on a turret.

BACKGROUND OF THE INVENTION

The technical field of the invention is more particularly the field of fabricating and installing production risers for undersea extraction of oil, gas, or other soluble or meltable material or a suspension of mineral material from a well head that is underwater up to a support that is floating, in order to develop production fields installed in the open sea off-shore. The main and immediate application of the invention lies in the field of producing oil.

The technical sector of the invention is more particularly the field of undersea oil production in areas where oceanic and weather conditions are difficult or extreme, or indeed in Arctic or Antarctic areas, and using floating supports.

In general, an oil production floating support includes anchor means in order to enable it to remain in position in spite of the effects of currents, winds, and swell. It also generally includes means for drilling, storing, and processing oil, together with unloading means for take-off tankers, which calls at regular intervals in order to take off the production. The usual term for such floating supports or ships is "floating production storage off-loading" (with the initials "FPSO" being used throughout the description below) or indeed floating drilling & production unit (FDPU), when the floating support is also used for performing drilling operations using wells that are deflected in the depth of the water.

When sea and weather conditions, i.e. swell, wind, and currents are heavy, or indeed extreme, as in storms, it is preferable to anchor the FPSO via a turret, which is generally situated in conventional manner at the front or in the front third of the ship and on its axis, with the ship being free to turn about said turret in response to the wind, currents, and swell. Thus, wind, currents, and swell exert specific forces on the hull and the superstructures, with the FPSO being free to turn about the vertical axis ZZ' and naturally taking up a position of the resistance. The pipes connecting the well heads are themselves connected in general to the underside of the turret and they are connected to the FPSO via a rotary joint incorporated on the axis of said turret, generally situated on the deck of said FPSO. When the weather conditions are likely to become extreme, as in the North Sea, in the Gulf of Mexico, or indeed in Arctic or Antarctic regions, the FPSO is generally disconnectable so as to be able to take shelter while waiting for acceptable operating conditions.

A floating production support having a system of anchor lines connected to the sea bottom and also bottom-to-surface connection pipes anchored to a turret comprises, in conventional manner:

- a rotary device called a "turret", comprising a cylindrical internal structure, preferably of circular section, within a cavity passing through the entire height of the hull of the floating support, said internal cylindrical structure being hinged to rotate relative to said hull by means of rotary guide elements, in particular by means of a rolling or friction bearing, and preferably a rolling bearing comprising wheels and guide tracks for said wheels, so as to allow said floating support to turn about a substantially vertical axis ZZ' of said cylindrical internal structure and of said cavity, without leading to significant turning of said cylindrical internal structure about the same vertical axis ZZ'; and
- a bottom mooring structure enabling firstly said anchor lines to be moored and secondly first flexible pipes connected to undersea pipes resting on the sea bottom to be connected directly or via bottom-to-surface connection pipes, said mooring structure being arranged under the hull of the floating support, being fastened to an underwater bottom wall of said cylindrical internal structure, and thus secured to said cylindrical internal structure, in such a manner that the mooring lines and said flexible pipes that are connected thereto are not caused to turn when said floating support is itself caused to turn; and
- said flexible pipes connected to said first flexible pipe or in continuity therewith rising within the cavity up to a connection of the type referred to as a rotary connection having a first portion that is secured to the deck of said hull that is connected to a plurality of pipes or lines on the deck, and a second portion secured to the top platform of said cylindrical internal structure situated above the level of the sea surface, the top ends of said flexible second pipes rising within said cylindrical internal structure of the turret being connected, generally via pipe bend elements, to said second connection portion, said first connection portion secured to the floating support on the deck of the floating support being hinged to rotate relative to said second portion of the connection secured to said cylindrical internal structure via a rotary connection so as to allow said floating support to turn without turning the ends of said second flexible pipes within said cylindrical internal structure.

The rolling bearing is located either level with the deck of the floating support, or else in a low portion in a wet zone, i.e. the bearing is underwater, or indeed it comprises a combination of both of the above configurations.

Said bottom wall of said cylindrical internal structure is preferably assembled thereto in leaktight manner so as to avoid the underwater portion of the inside of said internal structure being invaded by sea water. This waterproofing makes maintenance operations and other actions carried out by personnel inside the turret easier to perform, in particular in order to make connections to the flexible pipes. However, and above all, this sealing enables Archimedes' thrust to apply to the volume displaced by the cylindrical internal structure of the turret and lightens in part the vertical forces generated by the anchor lines, by said flexible pipes at the guide elements, and compensates for the weight of said cylindrical internal structure.

Numerous bottom-to-surface connection configurations have been developed, in particular in the Applicant's patents WO 2009/122098, WO 2009/122099, and WO 2010/026334, which describe an FPSO provided with such a turret and the associated flexible pipes, more particularly for use in the extreme conditions to be encountered in the Arctic. Such a configuration is advantageous for medium depths of water, i.e. in the range 100 meters (m) to 350 m, or indeed 500 m to 600 m. In particular, using flexible pipes over the full height of the water between the rigid undersea pipes resting on the sea bottom and the floating support allows the floating support to move to a greater extent than is possible when rigid pipes are used.

When the depth of water reaches 1000 m to 1500 m, or indeed 2000 m to 3000 m, installing flexible pipes over the entire depth of the water becomes very expensive since flexible pipes are very complex and difficult to fabricate, and it is preferred to use bottom-to-surface connections of the so-called "hybrid" tower type, in which the substantially vertical portion of the tower is constituted by rigid pipes between the sea bottom up to a depth of about 50 m to 100 m below the water surface, with the top ends of the rigid pipes then being connected to the FPSO via flexible pipes having a length of 150 m to 350 m and in the configuration of a catenary or a dipping double catenary. Numerous patents in the name of the Applicant show advantageous arrangements for making this type of bottom-to-surface connection, and in particular WO 2011/144864 in the name of the Applicant.

An oil field is generally constituted by a plurality of well heads situated at various distances from the FPSO, which may be as much as several kilometers, each of them being connected by pipes that may be rigid, or flexible, by umbilicals, and by electric cables. In general, the bottom-to-surface connection of a said well head comprises at least one pipe for producing oil or for injecting water or gas, plus an umbilical for controlling the well head, and possibly also one or more electricity cables. These rigid or flexible pipes, umbilicals, and cables are laid on the sea bottom beside one another and must not overlap along their length. Thus, the arrangement of the flexible pipes under the turret and the way they are connected to the turret depend on the layout of the well heads and of the undersea pipes resting on the sea floor and constituting the layout of the field. Furthermore, in certain circumstances, a large number of bottom-to-surface connections are required, and in order to avoid interference between said pipes in the depth of water, said flexible pipes are arranged side by side and close to one another, possibly in one or more circles, and in the same order as the ends of the pipes resting on the sea bottom, one beside another on the sea bottom 10.

Patent WO 2011/061422 A1 in the name of the Applicant describes an FPSO that is not provided with a turret, but that is anchored in permanent manner, with a north heading, on 16 anchor lines, with a plurality of bottom-to-surface connections coming from the west being connected all along the side of the vessel, thereby providing a large concentration of pipes coming in a single direction.

In certain oil field configurations, it can thus happen that the periphery of the turret, in particular the periphery of the bottom mooring structure and/or the bottom wall of said cylindrical internal structure presents a high concentration in a small region of flexible pipes of large diameter, and thus of large weight per unit length, that are all connected over a narrow angular zone of the periphery, whereas in a diametrically opposite zone, there are to be found only flexible pipes or cables of low weight per unit length, or indeed no pipes in certain circumstances. FIG. 4, described below, illustrates this type of arrangement.

However, a flexible pipe in suspension that is connected to the turret exerts tension thereon, which the turret takes up via the pipe's connection to said turret, which tension generates large vertical forces (force of magnitude F), and also lesser horizontal forces (force of magnitude H) where the pipe is connected to the turret, in particular for a bottom-to-surface link of great depth. Under such circumstances, a distribution of flexible pipes that is irregular and/or asymmetrical leads to force variations and thus to stress variations that are large all along the periphery of the turret, and these are transferred and taken up in non-uniform manner in particular via said rotary guide element. Furthermore, in an off-shore oil field there is generally a predominant direction for swell, winds, and currents, and when the floating support pivots about the turret under the effect of the swell and/or the wind or sea current, most movements are restricted in general to a substantially constant angular sector, e.g. ranging from north to southwest. Said rotary guide elements are then subjected to alternating forces that are localized in even more non-uniform manner around the periphery of the turret for this additional reason, thereby giving to increased or accelerated localized wear of said rotary guide elements.

OBJECT AND SUMMARY OF THE INVENTION

An object of the present invention is to provide a floating support anchored on a turret and a bottom-to-surface connection installation that are improved and that make it possible to solve the above-mentioned problems.

More particularly, an object of the present invention is to provide a floating support anchored on a turret and a bottom-to-surface connection installation that are improved and that enable the forces that are generated and transferred by the flexible pipes to the turret to be better distributed, and in particular transferred at the periphery of the turret via rotary guide elements that are subjected to forces that are vertical, in such a manner that said forces are distributed more regularly, more symmetrically, and/or in a manner that is more uniform in terms of intensity around the periphery of the turret.

In order to do this, one embodiment of the present invention provides a structure for guiding and offsetting a flexible pipe within said turret.

More precisely, in accordance with one embodiment of the present invention provides a floating petroleum production support supporting or suitable for supporting bottom-to-surface connection pipes between a plurality of undersea pipes resting on the seabed and the said floating support on the surface, said floating support including a turret having a cavity immersed at least in part within a structure offset to the front of the floating support or incorporated in or under the hull of the floating support, preferably passing through the hull of the floating support over its entire height, said turret comprising a cylindrical internal structure, preferably of circular section, within said cavity, said internal structure comprising a tubular side wall surmounted at its top end by a top platform coming substantially to the level of the deck of the floating support, said tubular side wall being closed at least in part at its bottom end by a bottom wall, said cylindrical internal structure passing or being suitable for passing a plurality of flexible first pipes connected to said top platform and extending under said bottom wall to undersea pipes resting on the sea bottom or to second pipes themselves connected to undersea pipes resting on the sea bottom, said cylindrical internal structure being mounted to rotate relative to said cavity and said hull via rotary guide elements, preferably at least one rolling or friction bearing, in such a manner as to allow said floating support to rotate about a substantially vertical axis ZZ' of the cavity of said turret without causing a portion of said turret to rotate relative to the same vertical axis ZZ', wherein said internal cylindrical structure comprises at least one, and preferably a plurality of preferably rigid guide and offset pipes containing and guiding or suitable for containing and guiding a said flexible first pipe, said guide pipe passing through said bottom wall and passing non-vertically inside said cylindrical internal structure of the turret between:

firstly said bottom wall at a first location C1 of said bottom wall where said guide pipe is fastened, said first location being preferably located at the periphery of said bottom wall; and secondly an internal platform secured to said internal cylindrical structure above said bottom wall and above the level of the water surface, the top end of said guide pipe being fastened to said internal platform at a second location C2 where the top end of said flexible pipe contained in said guide pipe is fastened or is suitable for being fastened, said second location not being in vertical alignment with said first location, said second location preferably being arranged at the periphery of said internal platform.

It can be understood that said flexible pipe passes through said bottom wall, passing through the inside of the guide pipe, without said flexible pipe being secured to said bottom wall.

In an embodiment, the top end of said flexible pipe is fastened to a connection element that is itself fastened to a said second location C2 where said top end of said first flexible pipe is connected.

Because the flexible pipes are not connected to the bottom wall but are merely guided and retained laterally, possibly with friction against the wall of said guide pipe in particular where it passes through the bottom wall, the essential portion of the vertical forces generated by said flexible pipes is transferred to said internal platform where they may be connected at said second locations in arrangements that are different from the arrangements of the first locations in said bottom wall, and thus in particular in such a manner as to be capable of transferring forces generated by said first flexible pipes in a distribution that is more regular and/or more symmetrical at said second locations than at said first locations, in particular around the periphery of said internal platform facing said rotary guide elements.

In other words, it can be understood that:

said first flexible pipes pass through said cylindrical internal structure of the turret between said first locations and said second locations in a different angular arrangement, preferably following curved paths that are S-shaped in projection onto a vertical plane, or in the form of a three-dimensionally warped S-curve, or in a form that is substantially straight, but that slopes relative to the vertical; and the forces transmitted by said top ends of said first flexible pipes and taken up at said internal platform are distributed in a manner that is more uniform and more symmetrical around the periphery of said internal platform than the forces transmitted by said first flexible pipes if they were to be taken up via the bottom platform at said first locations, assuming that said first flexible pipes were fastened thereto.

By peripheral arrangement, it should be understood that said locations are situated closer to the circumference than to the center of said bottom wall or and respectively said internal platform, preferably as close as possible to the periphery, and thus the bearings for rotation, without affecting strength.

More particularly, said first locations are arranged in a non-regular and/or non-symmetrical distribution along the periphery of said bottom wall.

More particularly, the number of said non-vertical guide pipes of the invention may lie in the range 1 to 100, preferably in the range 5 to 30.

Still more particularly, between said first location C1 and said second location C2, said non-vertical guide pipe describes a deflection through an angle $\alpha$ of at least 5° in a horizontal plane between a) a first vertical plane containing the vertical axis ZZ' of said cylindrical internal structure and the center of said first location C1, and b) a second vertical plane containing the vertical axis of said cylindrical internal structure and the center of said second location C2.

This value of $\alpha \approx 5°$ seeks to mark the difference between a said non-vertical guide pipe of the invention and a mere departure from the vertical of a vertical guide pipe of the I-tube type as known to the person skilled in the art in the field of the off-shore oil industry.

Still more particularly, between said first location C1 and said second location C2, said non-vertical guide pipe describes a deflection through an angle $\beta$ of at least 5° in a vertical plane between a) the vertical line passing through the center of said first location C1, and b) the sloping line D passing through the centers of both of said first and second locations C1, C2.

This value of $\beta \approx 5°$ seeks to mark the difference between a said non-vertical guide pipe of the invention and a mere departure from verticality of a vertical guide pipe of the I-tube type.

Preferably, the floating support of the invention includes a plurality of said non-vertical guide pipes for which said second locations C2 are arranged at the periphery of said circular internal platform in a more regular arrangement, preferably in an arrangement of said successive second locations in which the radial directions are angularly spaced apart by the same angle (gamma), and/or in an arrangement that is more symmetrical relative to a diametral plane LL than said first locations C1 arranged at the periphery of said circular bottom wall.

Still more particularly, said turret supports said flexible first pipes, at least some of said flexible first pipes passing via said non-vertical guide pipes arranged at said second locations in such a manner that the forces generated by said flexible first pipes are transferred and taken up in substantially more uniform and/or more symmetrical manner along the outline of the periphery of said internal platform than are the forces generated by said first pipes at the level of said first locations.

Still more particularly, said first pipes are arranged at said second locations in such a manner that the forces generated by said first pipes are distributed in substantially uniform and/or symmetrical manner over the outline of the periphery of said internal platform, said second locations preferably being arranged in substantially uniform and/or symmetrical manner over the outline of the periphery of said internal platform.

In a preferred variant, said turret includes at least one said guide pipe extending from said first location at said bottom wall to a said second location at said internal platform in substantially uniform and/or symmetrical manner over the outline of the periphery of said internal platform, following an S-shaped curved path.

The term "S-shaped" is used herein to mean a curved shape in a plane with a single point of inflection in its curvature, or indeed a warped S-shaped in three-dimensional space.

More particularly, when the guide pipe is curved, the axis of the pipe is not contained in a vertical plane.

In another variant embodiment, said turret has at least one said guide pipe extending from a said first location at said bottom wall to a second location at said internal platform following a path that is substantially a sloping straight line (β).

Still more particularly, said floating support comprises:

a top platform supporting at least a first portion of a rotary joint connection arranged axially ZZ' above said internal platform;

said top platform resting on first rotary guide elements, preferably a first rolling bearing, and supporting a first portion of said rotary connection, said first portion of said rotary connection being secured to said top platform, bent junction pipe elements connecting the top ends of said flexible first pipes at said internal platform to said first portion of said connection, a rotary second portion of said rotary connection being supported by the deck of the floating support; and a leaktight cylindrical internal structure, preferably of circular section about said vertical axis ZZ', including a bottom wall assembled in leaktight manner to the bottom end of the tubular side wall of said tubular internal structure; and a bottom mooring structure, preferably of annular shape coaxial with said cylindrical internal structure, connected to said bottom wall, at the bottom face of said bottom wall, with anchor lines extending from said bottom mooring structure to which they are moored down to the sea bottom and said flexible first pipes passing through said bottom mooring structure.

Still more particularly, said turret comprises:

a top platform bearing against a first rolling bearing arranged at the level of a step at the top end of said cavity, preferably in such a manner that said top platform does not project above the level of the deck of the floating support; and said lateral tubular wall of circular section of said cylindrical tubular internal structure co-operates with at least second and third lateral rolling or friction bearings, preferably rolling bearings, interposed between the cylindrical side wall of said cavity and said lateral tubular wall of said cylindrical internal structure and allowing said internal structure to rotate, said third rolling or friction bearing being situated beneath said second lateral bearing, said second bearing preferably being above the surface of the water in the proximity of the level of said internal platform, said third lateral bearing being situated in the proximity of the level of said bottom wall.

It can be understood that in this embodiment:

said cylindrical internal structure is rotatably mounted relative to said cavity and said hull via said rotary guide elements, preferably at least one rolling or friction bearing, so as to allow said floating support to turn about a substantially vertical axis ZZ' of the cavity of said turret without causing said cylindrical internal structure of said turret to turn about the same vertical axis ZZ', said mooring lines and said first flexible pipes extending under the turret being suitable for remaining stationary in rotation about the axis ZZ' relative to the sea bottom, while said floating support is itself caused to turn about the vertical axis ZZ' of said cylindrical internal structure or said cavity of the turret; and said first portion of the rotary coupling co-operates in leaktight manner with the second portion of the rotary coupling so as to transfer fluids or electrical currents coming from or going to the flexible pipes and electric cables, while allowing said floating support to turn (together with said second portion of the rotary coupling) about a substantially vertical axis ZZ' of the cavity of said turret, without turning said first flexible pipe inside said cylindrical internal structure relative to the same vertical axis ZZ'.

Still more particularly, said rolling bearing(s) is/are constituted by rollers or wheels guided in rolling tracks, said rolling tracks and said rollers or wheels being arranged circularly around said internal structure, and preferably being regularly spaced apart.

The present invention also provides a bottom-to-surface connection installation including a floating support of the invention, further comprising at least one rigid second pipe providing a connection between the bottom end of a said flexible first pipe extending below said turret and the end of an undersea pipe resting on the sea bottom.

In a variant embodiment, said rigid second pipe is arranged as a substantially vertical riser, said flexible first pipe to which it is connected adopting a dipping double catenary shape.

In another variant embodiment, said rigid second pipe is of the so-called steel catenary riser (SCR) type, extending with a curved shape known as a single catenary between the end of a pipe resting on the sea bottom and the bottom end of a said flexible first pipe opening out below said turret and in continuity of curvature with said flexible first pipe.

BRIEF DESCRIPTION OF THE DRAWINGS

Other characteristics and advantages of the present invention appear more clearly in the light of the following detailed description made in non-limiting illustrative manner with reference to the drawings, in which.

DETAILED DESCRIPTION OF THE PREFERRED EMBODIMENTS

Figure 1:
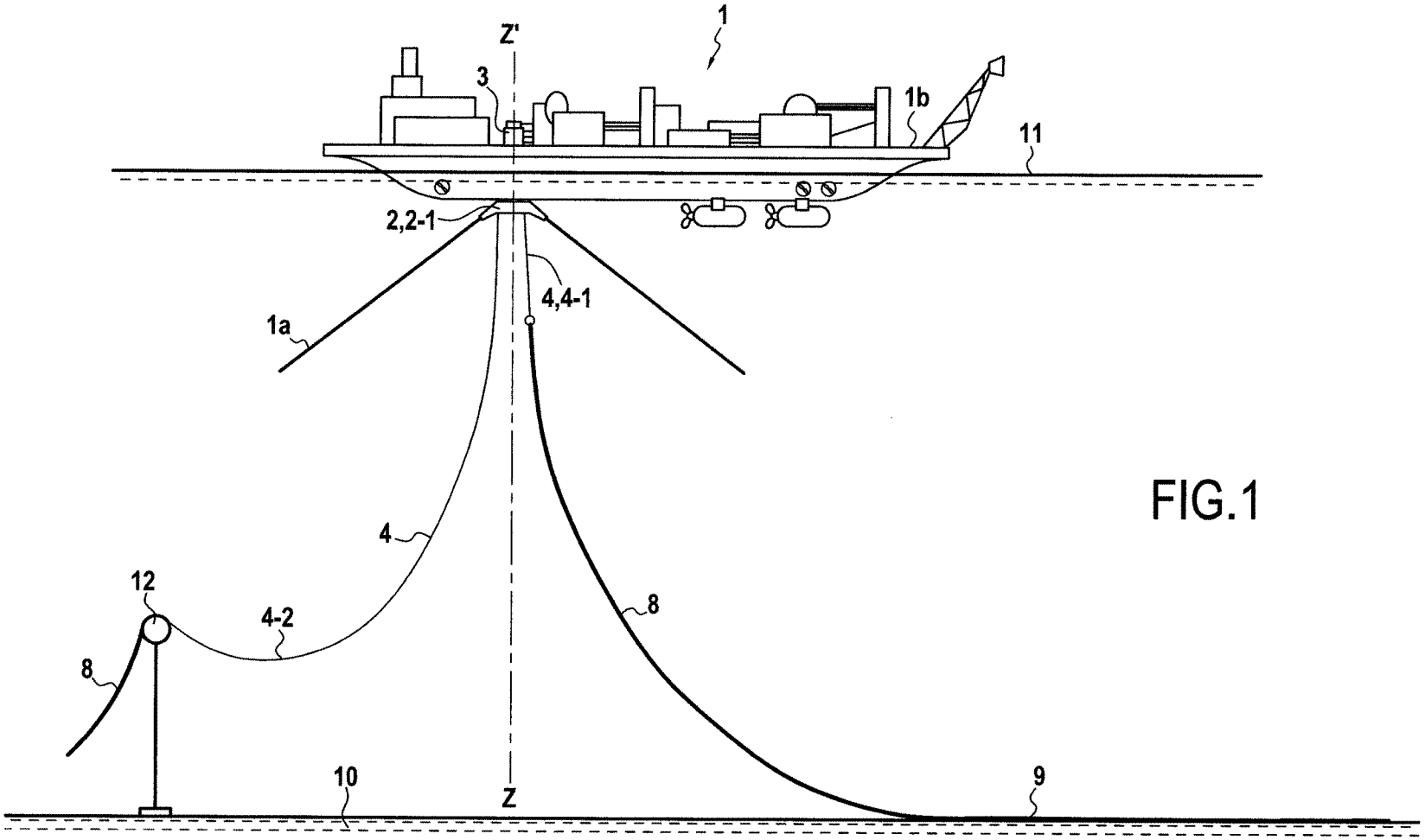
FIG. 1 is a side view of an FPSO 1 having a turret 2 situated in the front third of the hull, the turret being anchored at 1*a* and having bottom-to-surface connection pipes 4, 8 extending to undersea pipes 9 resting on the sea bottom 10.

FIG. 1 is a side view of an FPSO type floating support 1 secured to a turret 2 situated in the front third of said FPSO. Said turret 2 is anchored by a plurality of anchor lines 1*a* connected to anchors (not shown) that are engaged in the seabed 10. The turret, known to the person skilled in the art, is shown in section in FIG. 2 and presents an internal cylindrical structure 2*a* that is substantially stationary in rotation about the axis ZZ' relative to the seabed 10, inside a cavity 2*d* that passes through the hull 1*d* of the floating support 1. The turret 2 is constituted by a tubular structure 2*a* that is made watertight at its bottom end by a bottom wall 2*b* and that has a top platform 2*c* at its top end, which platform is of greater diameter than the tubular side wall 2*a*, said platform 2*c* having peripheral portions projecting beyond the tubular side wall 2*a* that bear against a step 1*c* at the top end of the cavity 2*d*.

Said internal cylindrical structure 2*a* and the hull 1*d* co-operate in relative rotation via rolling bearings 2*a*1, 2*a*2, and 2*a*3 comprising top and bottom circular lateral guide bearings 2*a*2 and 2*a*3 that transfer horizontal forces between the turret and the structure of the FPSO, and a top circular support rolling bearing 2*a*1 that transfers all of the vertical forces between the top platform 2*c* of the turret and the deck of the FPSO. This enables the FPSO to pivot freely about the vertical axis ZZ' of the turret and to take up a position in a direction corresponding to the resultant of the forces generated by swell, wind, and current on the FPSO and its superstructures, without the internal cylindrical structure 2*a* of the turret 2 pivoting, which structure thus remains substantially stationary in rotation about the axis ZZ' relative to the sea bottom 10.

Said bearings 2*a*1, 2*a*2, and 2*a*3 are friction bearings or rolling bearings, and they are preferably rolling bearings. More particularly, they may involve rollers or wheels interposed between:

- the inside wall of the cavity 2*d* and the outside surface of the tubular side wall 2*a*, for the lateral guide rollers or wheels 2*a*2 and 2*a*3; and
- the horizontal surface of the step 1*c* and the underface of the top platform 2*c* of the turret 2, for the support bearing 2*a*1.

It can be understood that at least at said bearings, said tubular structure 2 and said cavity inside wall 2*d* present a section that is circular. The rollers or wheels of the bottom and top lateral guide bearings 2*a*2 and 2*a*3 are arranged more particularly with their axes of rotation in a vertical position. For the top support bearing 2*a*1, said rollers or wheels are arranged with their axis of rotation in a horizontal position so that they bear on the step 1*c*, with the platform 2*d* resting on the edges of said rollers 2*a*1.

Figure 2:
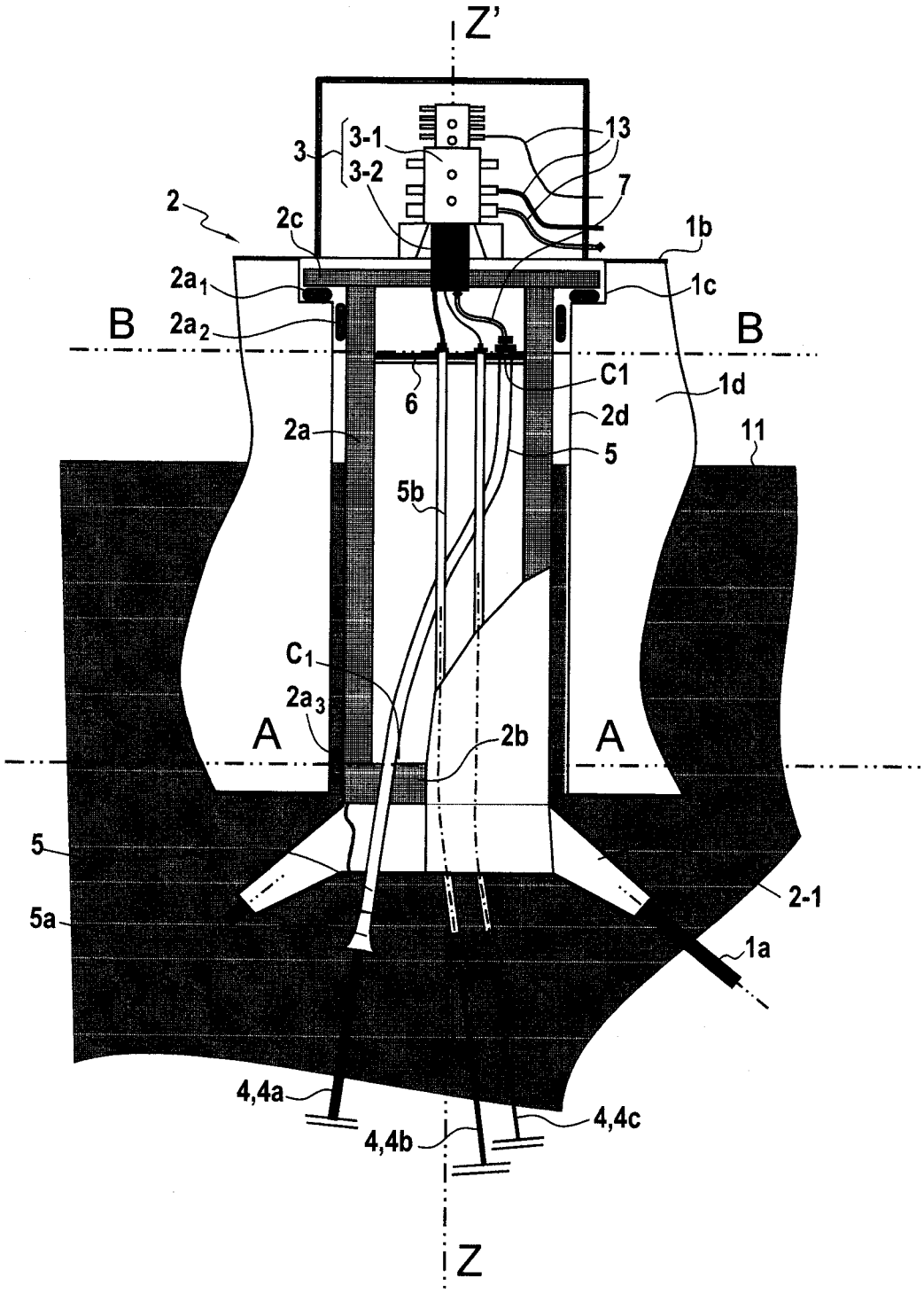
FIG. 2 is a cutaway section view and side view of a turret 2 incorporated in the hull of an FPSO 1 of the invention showing in detail the path followed by an S-shaped guide pipe 5 of the invention, from a flexible pipe 4 at the bottom wall 2*b* of said turret 2 to an internal platform 6 situated in the plane BB at a high level of said turret, said plane BB being arranged well above the water level 11, plus strong swell, when said FPSO 1 has maximum ballast.
Figure 3:
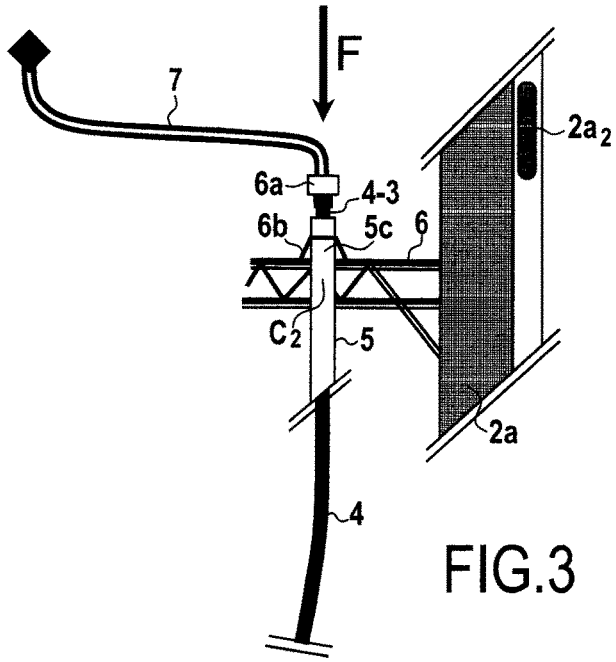
FIG. 3 is a detail view showing the connection of the top ends of flexible pipes 4 via connection elements 6*a* fastened on the internal platform 6.

FIGS. 1 and 2 also show the bottom mooring structure 2-1 fastened under the bottom wall 2*b* and having said anchor lines 1*a* fastened thereto. The bottom structure 2-1 is annular in shape and has a plurality of said flexible first pipes passing through its center, including production pipes together with umbilical connections and electric cables 4 of various sizes, lightweight 4*c*, medium 4*b*, and heavy 4*a*, which pass through the bottom wall by passing into the ends 5*a* of guide pipes 5 supported by and passing through the bottom wall 2*b* and then rising inside the watertight cylindrical structure 2*a*, being guided by non-vertical guide pipes 5 of the invention, with some of them being guided in vertical guide pipes 5*b* of the prior art. The top ends 4-3 of the flexible first pipes 4 pass out through the top ends 5*c* of the guide pipes passing through the internal platform 6 and they are connected to connection elements 6*a* that are supported by the internal platform 6 that is fastened to the inside and at the top of said internal structure 2 beneath the rotary joint connection 3, the bottom portion 3-2 being axially supported by the top platform 2*c* of the internal cylindrical structure 2*a*. Finally, junction pipes 7 with bends provide junctions between the top ends 4-3 of the flexible first pipes 4 between the internal platform 6 and the rotary joint connection 3-2.

In shallow sea, i.e. when the depth of water lies in the range 200 m to 750 m, or indeed up to 1000 m, the bottom-to-surface connection pipe and the pipes 9 resting on the sea bottom are generally flexible pipes, such as the pipes fabricated for the oil industry by Technip (France) or by Wellstream (USA). In contrast, when the depth of water exceeds 1000 m to 1500 m, it is preferred for the production pipes or the water or gas injection pipes to install rigid second pipes 8 made of steel and optionally insulated, between the undersea pipes 9 resting on the sea bottom and said flexible first pipes terminating in the subsurface beneath the turret of the FPSO. It is possible to have a rigid second pipe 8 connecting the sea bottom to the end of a flexible first pipe 4 at a float 12 that is at a distance below sea level of about 50 m to 100 m. Said rigid second pipe 8 may be vertical (not shown) or it may be of the SCR type, forming a curve known as a "catenary", having characteristics that are in general equivalent to those of production pipes, the connection with the FPSO then being provided by the flexible first pipes in a dipping double catenary configuration 4-2. When the depth of water is greater than 1000 m, the use of flexible first pipes of great length, which are very expensive, is avoided, and the rigid pipe 9 resting on the seabed is advantageously extended up to the FPSO in a simple catenary riser configuration, as shown in FIG. 1, the top portion of the bottom-to-surface connection then possibly being constituted by a portion of flexible pipe 4-1 providing a flexible connection with the turret 2 of the FPSO, said portion of flexible first pipe 4 then presenting curvature that is continuous with the top end of the rigid second pipe 8 of the SCR type, and preferably having the same inside diameter, with a total length lying in the range 50 m to 100 m, for example. In such a configuration, the forces generated by the bottom-to-surface connection 4, 8 on the turret are very large because of the depth of the water, which under such circumstances needs to be greater that 750 m to 1000 m.

Figure 4:
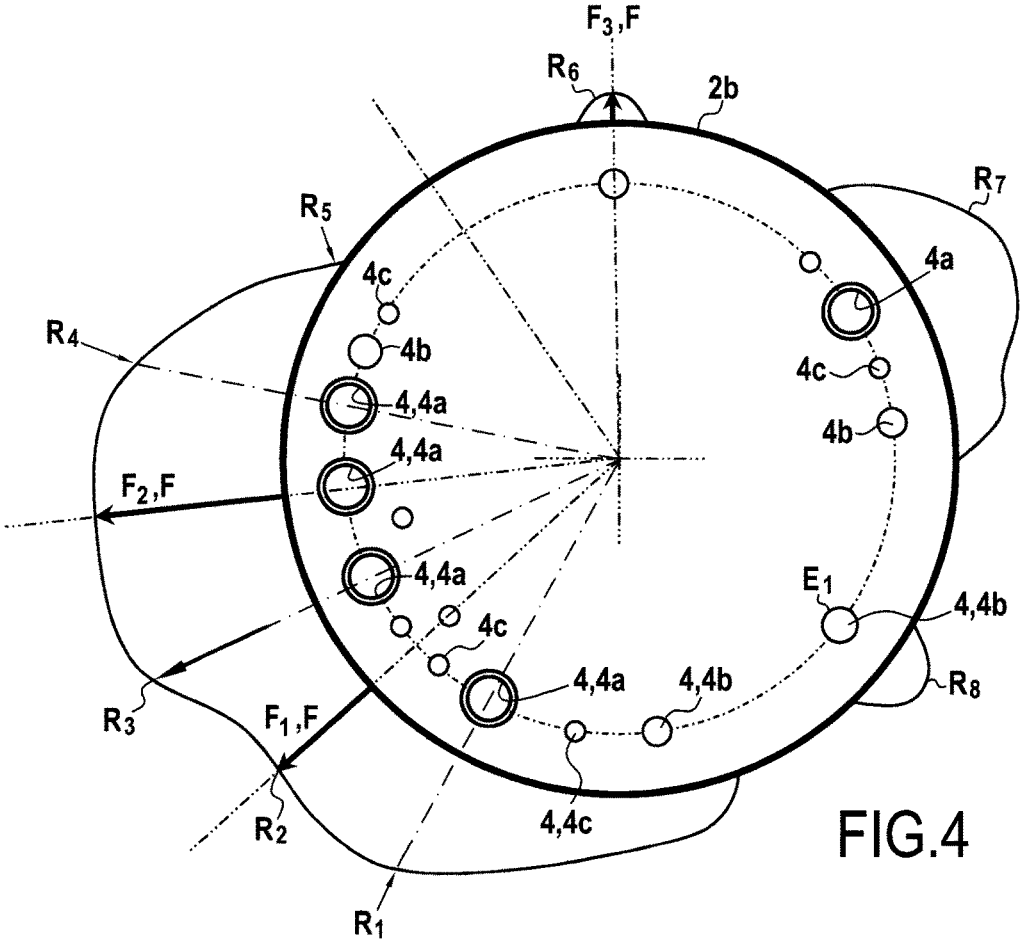
FIG. 4 is a wind rose type representation of the distribution of vertical forces at the periphery of a turret, as created by the set of flexible pipes 4 connected thereto, in a conventional prior art configuration.

In certain field configurations, there are to be found in the bottom portion of the turret a concentration of flexible pipes 4*a* that are of large diameter and thus of large weight per unit length, all reaching a small zone of the periphery of the turret, whereas in another zone of the periphery in a position that is diametrically opposite, there may be only flexible pipes or cables that are of small weight per unit length reaching the turret, or indeed in certain circumstances, no pipes at all. FIG. 4 shows the effects of this configuration in an embodiment of the prior art when the flexible first pipes 4 are connected to the bottom wall and the forces are essentially taken up and transferred by said bottom wall of the turret. In FIG. 4 there can be seen:

- on the left, four flexible pipes 4*a* of large diameter, thus of large weight per unit length, and thus giving rise to large vertical tensions and forces;
- on the right, only one large diameter flexible pipe 4*a*; and also
- distributed around the periphery of the turret, a plurality of medium flexible pipes 4*b*, together with small flexible pipes 4*c*.

The weight of the turret structure itself and the vertical forces due to the anchoring 1*a* are distributed substantially uniformly over the periphery of the turret, and thus the rotary guide elements 2*a*1 and the running tracks secured respectively to the FPSO and to the turret are substantially all stressed in uniform manner by those vertical forces. In contrast, the irregular and/or asymmetrical distribution of said suspended flexible pipes 4 gives rise to vertical forces around the periphery of the turret that are not uniform, thereby leading to stress variations that may be very large. Thus, FIG. 4 shows a vertical force rose R that is similar to a wind rose known to the person skilled in the art in the field of meteorology, for representing the variation in vertical forces F per unit length on the periphery of said turret: F then represents the vertical force per unit length, e.g. per curvilinear meter of the circumference of the top platform applied on the rotary bearing 2*a*1 and resulting from the distribution of the various flexible pipes in said peripheral zone of the turret when these forces are taken up via the bottom wall where the pipes are connected using the prior art technique or are transferred vertically without changing their distribution to a top platform to which they are connected. Thus, in the bottom left portions of FIG. 4, because of the large concentration of heavy flexible pipes 4*a* and a plurality of medium and small pipes 4*b* and 4*c*, the force rose R presents the following variations in a clockwise direction:

- from the bottom of the figure, a value that increases from a zero value up to R1, followed by a value that decreases a little to R2 (F1);
- then once more a value that increases to reach a maximum $F_2$ between R3 and R4, and finally a value that decreases down to zero from R4 to R5;
- thereafter, there is an entire range with a value F that is substantially zero up to the top of said figure;
- then there is a zone R6 where the force rose has a low value $F_3$ because of the presence of a medium flexible pipe 4*b;*
- thereafter there is a zone where F has a value that is substantially zero;
- this continues to a zone on the right of the figure where the presence of a plurality of flexible pipes of various sizes gives rise to the force rose R7;
- then once more there is a zone where F has a value that is substantially zero;
- followed by a zone where the force rose R8 has a low value because of the presence of a single medium flexible pipe; and finally
- a zone where F has a value that is substantially zero.

Thus, when the FPSO 1 pivots about its turret 2 that is substantially stationary relative to the sea bottom 10, the running tracks and the rotary bearings 2*a*1, 2*a*2, and 2*a*3 are continuously subjected to vertical forces (2*a*1) and to horizontal forces (2*a*2 and 2*a*3) that are smaller varying from a value zero to a maximum value as explained above, thereby leading to localized fatigue that is often made worse by the fact that the angular variations of the FPSO are often reduced to a limited sector, e.g. from azimuth 260° to azimuth 325°, e.g. corresponding to 90% of the time where the resultant of the effects of swell, wind, and current on the FPSO tend to keep the FPSO in this range of azimuth values. Thus, running tracks and rotary bearings are subjected to greater alternating forces in this angular sector and present accelerated wear and fatigue in this angular sector, whereas other sectors are subjected to practically no major force, and therefore suffer little significant wear and practically zero fatigue, during the lifetime of the installation, which in general may be as much as 20 years to 25 years, or even more.

In order to limit the extreme values of the localized forces F and in order to smooth out the shape of the force rose R around the periphery of the turret, the present invention, as shown in FIGS. 2, 5A, 5B, and 6, provides a non-vertical guide device for the flexible pipes within the turret serving advantageously to modify the distribution of load transfer that is generated by the said flexible pipes within the turret 2.

FIG. 2 shows a turret 2 of an FPSO 1 that has a rigid steel guide pipe 5 of S-shape passing through it from bottom to top. Said guide pipe 5 is fitted in its bottom portion with a trumpet-shaped funnel 5*a* to avoid damaging the flexible pipe 4 that it contains and guides in the zone where contact is made on entering into the bottom end of the guide pipe. Said guide pipe 5 passes the bottom wall 2*b* of the turret in leaktight manner at a first location centered on C1 at the periphery of the bottom wall. The top portion of said guide pipe 5 is secured at 6*b* to an internal support platform 6 that is secured to the internal cylindrical structure 2*a* of the turret 2 in the plane BB above the surface of sea water and below the top platform 2*c* of the turret. Said internal platform 6 also supports the top end of said flexible first pipe contained in said guide pipe fitted with a connection element 6*a* leading to the outside of the guide pipe. The internal platform 6 supports all of said flexible first pipes, and thus substantially all of the vertical forces from each of said flexible pipes.

The top end of said pipe 4 is connected via a junction pipe 7 to a portion 3-2 of the rotary joint connection 3. Said portion 3-2 of the connection 3 is secured to the turret, and is therefore substantially stationary in rotation relative to the sea bottom. Thereafter, the fluid leaves the portion 3-1 of the connection 3 secured to the deck 1*b* and the top platform 2*c* via a pipe 13. The portion 3-1 of the rotary joint connection 3 is secured to the deck of the FPSO 1 and is thus free to rotate about the axis ZZ' of the turret 2 relative to the portion 3-2 that is secured to the turret 2. The same goes for the other flexible pipes 4*b* and 4*c* connected to the rotary joint at 3-2 via junction elements 7 and leaving at 3-1 via pipes 13 on the deck 1*b*.

Figure 5A:
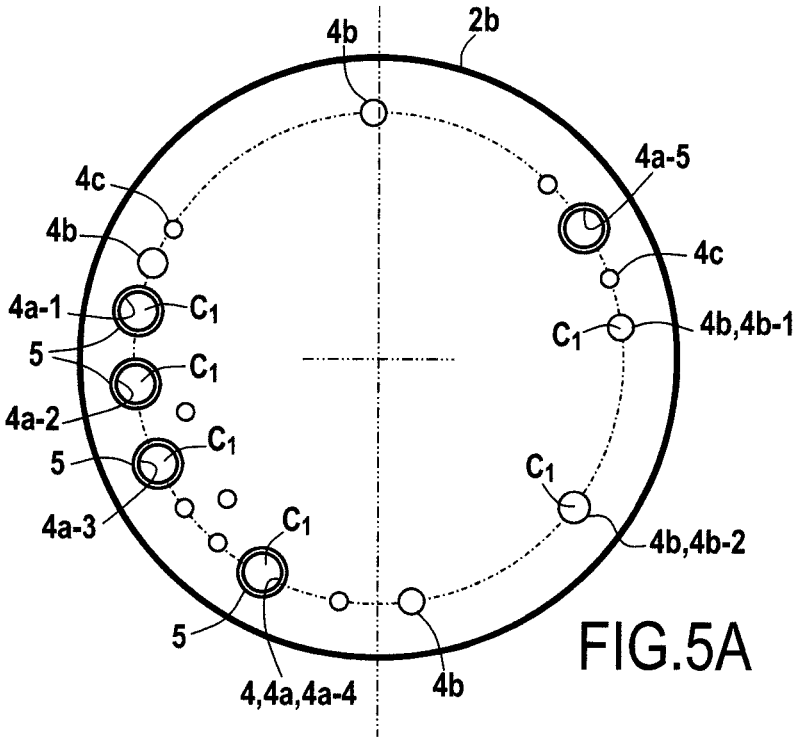
FIG. 5A is a section view of a turret 2 of the invention on the plane AA of FIG. 2, showing in detail the locations of various flexible pipes, umbilical connections, and electric cables 4, of small, medium, and large sizes 4*c*, 4*b*, and 4*a;*

FIG. 5A is a section view from above showing the section plane AA of FIG. 2 and it shows all of the flexible pipes 4, 4*a*, 4*b*, and 4*c* that are not connected to the bottom wall but that are contained in and guided by guide pipes that pass through the bottom wall 2*b* at first locations with centers C1 in a distribution that is determined by the layout of the field, as explained above with reference to FIG. 4. The vertical forces are transferred substantially in full to the internal platform 6 from which the pipes are suspended.

Figure 5B:
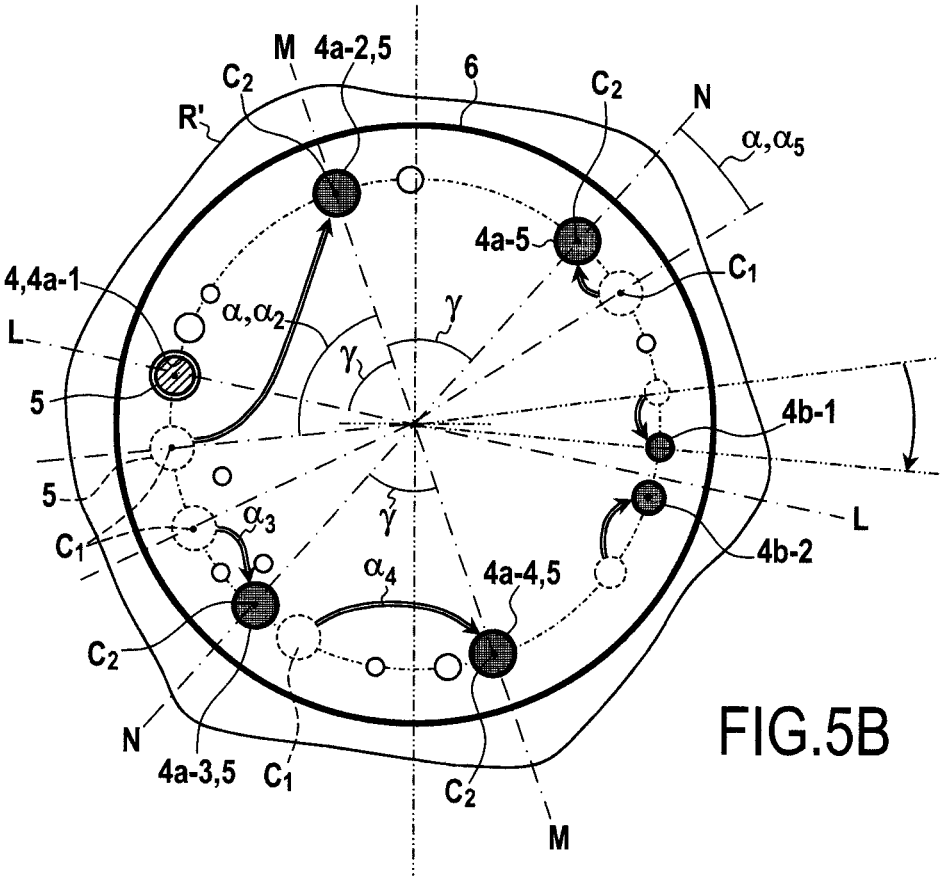
FIG. 5B is a section of the same turret of the invention as shown in FIG. 5A, at the level of the plane BB in FIG. 2, showing in detail how the various flexible pipes, umbilical connections, and electric cables of small, medium, and large size are reorganized, together with the new force rose R' resulting from this reorganization, said second locations of the flexible first pipes being shown diagrammatically by shading when they have been offset relative to said first locations, which first locations are shown using dashed lines.

FIG. 5A shows four guide and offset pipes 5 of the invention for heavy flexible pipes 4*a*-2 to 4*a*-5, together with two guide and offset pipes 5 for medium flexible pipes 4*b*-1 and 4*b*-2, together with a plurality of other guide pipes that are conventional and substantially vertical for flexible pipes that are medium and small, the conventional pipes being distributed around the periphery. In FIGS. 5A and 5B, said guide pipes for the flexible pipes 4*a*-2 to 4*a*-5 are S-shaped guide pipes of the invention, whereas the guide pipes, and in particular the guide pipes or the flexible pipe 4*a*-1 are conventional pipes of the I-tube type that are known to the person skilled in the off-shore art, and referenced 5*b* in FIG. 1.

FIG. 5B shows the positions of the top ends 5*c* of the guide pipes 5 for the same flexible pipes 4*a*-2 to 4*a*-5 that are fastened at 6*b* to the periphery of the platform 6 in second locations having centers C2. The heavy flexible pipe 4*a*-1 is substantially in the same position at the top and at the bottom (FIG. 5A), and its guide pipe is of the I-tube type, i.e. is substantially vertical. The flexible pipes 4*a*-2 to 4*a*-5 are offset by the S-shaped guide pipes of the invention and they are thus to be found advantageously distributed in regular manner around the periphery, substantially one every 60° (γ) on axes LL-MM-NN, and they are arranged substantially symmetrically relative to LL. The respective offsets of the second locations C2 relative to the first locations C1 are represented by arrows in FIG. 5B and they correspond to angles α2 to α5 that are greater than 5°, lying in this example in particular in the range 10° to 60°, in a horizontal plane between the substantially vertical radial planes containing the axis ZZ' and passing via C1 and via C2 respectively. The two medium flexible pipes 4*b*-1 and 4*b*-2 are moved towards each other by two S-shaped guide pipes, substantially symmetrically relative to the axis LL, thereby creating a minor offset of the order of 5° to 8°.

Thus, the heavy loads are essentially distributed regularly and symmetrically around the periphery of the platform 6 and thus transferred regularly and symmetrically so as to be taken up at the level of the bearing 2*a*1 with a small force peak substantially once every 60°, without creating major stress variations on the turret, the hull, and the rolling bearings. During movements of the FPSO 1 around its turret 2, which is substantially stationary relative to the sea bottom, this leads to stress and local fatigue levels that are greatly reduced, and also to overall fatigue that is substantially uniform on the rolling elements, and above all on the running tracks, all around the periphery of the turret. This leads to better behavior of the entire bottom-to-surface installation throughout the lifetime of the installation, which is commonly 15 years to 20 years and possibly more, without requiring major maintenance, such as a period in dry dock or stripping down and changing these very critical components that are subject to wear, as is commonly observed in the prior art.

Figure 6A:
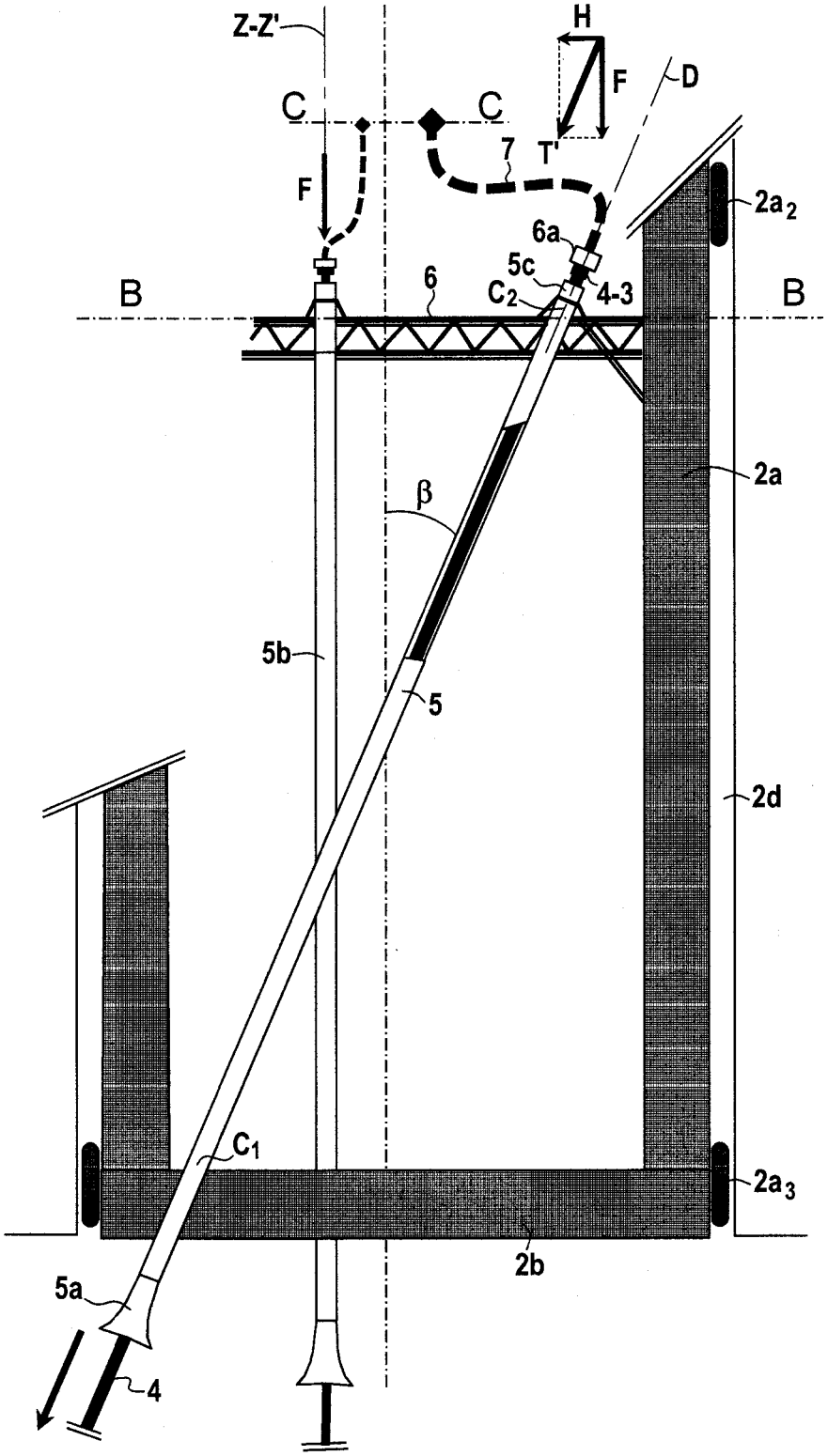
FIG. 6A is a vertical section view of the turret including a guide and offset pipe 5 of the invention that is rectilinear and sloping, together with a prior art I-tube vertical guide pipe 5*b*.
Figure 6B:
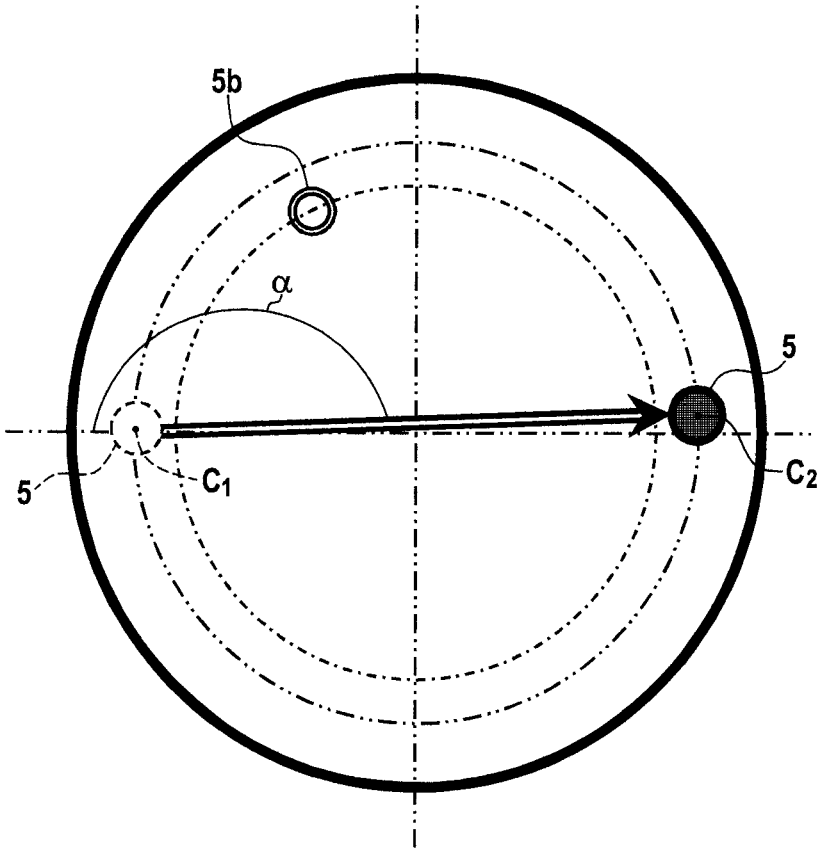
FIG. 6B is a horizontal section view on plane BB showing the FIG. 6A device showing an offset of the guide pipe 5 of the invention.

By way of illustration, FIGS. 6A and 6B show an embodiment of a non-vertical guide pipe 5 of the invention that is rectilinear in shape extending along a line D sloping at an angle β that is greater than 5° relative to the vertical, and that is equal to about 30° in this example, over a height H between the bottom wall 2*b* and the internal platform 6 over at least 75% of the height of the turret, i.e. H=10 m to 20 m. This results in said second location being offset by an angle α of 175°, as shown in FIG. 6, in a horizontal plane between the radial plane containing the axis ZZ' and passing respectively via C1 and via C2. Rather than using rectilinear guide pipes of the invention, it is preferred to use guide pipes that are S-shaped in a plane or in three-dimensional space, since that makes it easier to install a greater number of guide pipes in the inside of the turret without running the risk of interference between said pipes 5, or indeed of a congested zone that limits potential access for inspection and maintenance.

By way of example, an FPSO turret passing right through the hull of the floating support over a height lying in the range 30 m to 55 m, has a diameter of 10 m to 25 m, and in particular 12 m to 16 m, and its own weight lies in the range about 2500 metric tonnes (t) to 5000 t. Together the vertical forces due to the bottom-to-surface connection pipes may amount to 5000 t to 7500 t or indeed 10,000 t. The large flexible pipes in deep water can each lead to forces lying in the range 100 t to 250 t when using catenaries 4-2 such as those described with reference to FIG. 1, and when using rigid pipes 8, 4-1 in an SCR configuration, the vertical forces may be as much as 750 t to 1000 t, or even more for each of the lines.

It is thus possible to install a large number of pipes for gas, for crude products, for umbilical hydraulic connections, and for electric cables 4*a*-4*c*, e.g. 36 or 48 flexible pipes 4, regardless of the layout of the oil field and the locations of the various well heads around the FPSO.

The invention claimed is:

1. A floating petroleum production support supporting or suitable for supporting bottom-to-surface connection pipes between a plurality of undersea pipes resting on the seabed and said floating support on the water surface, said floating support including a turret having a cavity immersed at least in part within a structure offset to a front of the floating support or incorporated in or under a hull of the floating support, said turret comprising a cylindrical internal structure, within said cavity, said cylindrical internal structure comprising a tubular side wall surmounted at a top end of the cylindrical internal structure by a top platform coming substantially to the level of a deck of the floating support, said tubular side wall being closed at least in part at a bottom end by a bottom wall, said cylindrical internal structure passing a plurality of flexible first pipes connected to said top platform and extending under said bottom wall to the undersea pipes resting on the sea bottom or to second pipes which are connected to the undersea pipes resting on the sea bottom, said cylindrical internal structure being mounted to rotate relative to said cavity and said hull via rotary guide elements in such a manner as to allow said floating support to rotate about a substantially vertical axis ZZ' of the cavity of said turret without causing a portion of said turret to rotate relative to the vertical axis ZZ', wherein said cylindrical internal structure comprises a plurality of rigid guide pipes containing and guiding said flexible first pipes, said guide pipes passing through said bottom wall and passing non-vertically inside said cylindrical internal structure of the turret between:

firstly said bottom wall at first locations (C1) of said bottom wall where said guide pipes are fastened; said flexible first pipes passing through said bottom wall and passing through the inside of said guide pipes without said flexible first pipes being secured to said bottom wall, and secondly a circular internal platform secured to said cylindrical internal structure above said bottom wall and above the level of the water surface, top ends of said guide pipes being fastened to said circular internal platform at second locations (C2) where top ends of said flexible first pipes contained in said guide pipes are fastened, said second locations not being in vertical alignment with said first locations and said second locations (C2) are arranged at a periphery of said circular internal platform in an arrangement, wherein all of said successive second locations are equiangularly spaced apart and/or in an arrangement that is symmetrical relative to a diametral plane (LL) along the periphery of said circular internal platform while said first locations are arranged in a non-equiangular arrangement and/or in an arrangement that is non-symmetrical relative to a diametral plane (LL) along a periphery of said bottom wall.

2. The floating support according to claim 1, wherein at least one of said guide pipes describes a deflection through an angle alpha of at least 5° in a horizontal plane between a) a first vertical plane containing the vertical axis (ZZ') of said cylindrical internal structure and the center of one of said first locations (C1), and b) a second vertical plane containing the vertical axis of said cylindrical internal structure and the center of one of said second locations (C2).

3. The floating support according to claim 1, wherein at least one of said guide pipes describes a deflection through an angle β of at least 5° in a vertical plane between a) a vertical line passing through the center of one of said first location (C1), b) and a- sloping line passing through the centers of both of one of said first locations (C1) and one of said second locations (C2).

4. The floating support according to claim 1, wherein the floating support supports said flexible first pipes, at least some of said flexible first pipes passing via said guide pipes arranged at said second locations in such a manner that the forces generated by said flexible first pipes are transferred and taken up in uniform and/or symmetrical manner relative to a diametral plane (LL) along the periphery of said circular internal platform while the forces generated at the level of said first locations are not distributed in an uniform and/or symmetrical manner relative to a diametral plane (LL) along the periphery of said bottom wall.

5. The floating support according to claim 1, wherein the floating support includes at least one of said guide pipes extending from one of said first locations at said bottom wall to one of said second locations at said circular internal platform, following an S-shaped curved path.

6. The floating support according to claim 1, wherein said floating support includes at least one of said guide pipes extending from one of said first locations at said bottom wall to one of said second locations at said circular internal platform following a path that is a sloping straight line (β).

7. The floating support according to claim 1, wherein:

said top platform supports at least a first portion of a rotary joint connection arranged axially (ZZ') above said circular internal platform;

said top platform resting on first rotary guide elements and supporting a first portion of said rotary connection, said first portion of said rotary connection being secured to said top platform, bent junction pipe elements connecting the top ends of said flexible first pipes at said circular internal platform to said first portion of said connection, a rotary second portion of said rotary connection being supported by the deck of the floating support; and said cylindrical internal structure being of circular section about said vertical axis (ZZ'), including said bottom wall assembled in leaktight manner to the bottom end of the tubular side wall of said circular internal structure; and a bottom mooring structure, being of annular shape coaxial with said cylindrical internal structure, connected to said bottom wall, at the bottom face of said bottom wall, with anchor lines extending from said bottom mooring structure to which they are moored down to the sea bottom and said flexible first pipes passing through said bottom mooring structure.

8. The support according to claim 7, wherein:

said top platform bears against a first rolling bearing arranged at the level of a step at the top end of said cavity, and said tubular side wall of circular section of said cylindrical tubular internal structure co-operates with at least first and second lateral bearings which are rolling or friction bearings, interposed between the cylindrical side wall of said cavity and said tubular side wall of said cylindrical internal structure and allowing said cylindrical internal structure to rotate, said second lateral bearing being situated beneath said first lateral bearing, said first lateral bearing being above the surface of the water in the proximity of the level of said circular internal platform, said second lateral bearing being situated in the proximity of the level of said bottom wall.

9. The floating support according to claim 8, wherein said lateral bearings comprise rolling bearings constituted by rollers or wheels guided in rolling tracks, said rolling tracks and said rollers or wheels being arranged circularly around said circular internal structure.

10. A bottom-to-surface connection installation comprising a floating support according to claim 1, wherein the connection installation further comprises at least one rigid second pipe providing a connection between the bottom end of a said flexible first pipe extending below said turret and the end of an undersea pipe resting on the sea bottom.

11. The bottom-to-surface connection installation according to claim 10, wherein said rigid second pipe is of the so-called SCR type, extending with a curved shape known as a single catenary between the end of a pipe resting on the sea bottom and the bottom end of a said flexible first pipe, said flexible first pipe adopting a dipping catenary shape.

12. The bottom-to-surface connection installation according to claim 10, wherein said rigid second pipe is of the so-called SCR type, extending with a curved shape known as a single catenary between the end of a pipe resting on the sea bottom and the bottom end of a said flexible first pipe opening out below said turret and in continuity of curvature with said flexible first pipe.

13. A floating petroleum production support supporting or suitable for supporting bottom-to-surface connection pipes between a plurality of undersea pipes resting on the seabed and said floating support on the water surface, said floating support including a turret having a cavity immersed at least in part within a structure offset to a front of the floating support or incorporated in or under a hull of the floating support, said turret comprising a cylindrical internal structure, within said cavity, said cylindrical internal structure comprising a tubular side wall surmounted at a top end of the cylindrical internal structure by a top platform coming substantially to the level of a deck of the floating support, said tubular side wall being closed at least in part at a bottom end by a bottom wall, said cylindrical internal structure passing a plurality of flexible first pipes connected to said top platform and extending under said bottom wall to the undersea pipes resting on the sea bottom or to second pipes themselves connected to undersea pipes resting on the sea bottom, said cylindrical internal structure being mounted to rotate relative to said cavity and said hull via rotary guide elements in such a manner as to allow said floating support to rotate about a substantially vertical axis ZZ' of the cavity of said turret without causing a portion of said turret to rotate relative to the vertical axis ZZ', wherein said cylindrical internal structure comprises a plurality of rigid guide pipes containing and guiding said flexible first pipes, said rigid guide pipes passing through said bottom wall and passing non-vertically inside said cylindrical internal structure of the turret between:

firstly said bottom wall at first locations (C1) of said bottom wall where said guide pipes are fastened; and secondly a circular internal platform secured to said cylindrical internal structure above said bottom wall and above the level of the water surface, top ends of said guide pipes being fastened to said circular internal platform at second locations (C2) where top ends of said flexible pipes contained in said guide pipes are fastened, said second locations not being in vertical alignment with said first locations, and wherein at least one of said said guide pipes extending from one of said first locations at said bottom wall to one of said second locations at said circular internal platform follows an S-shaped curved path.

* * * * *